US005516100A

United States Patent [19]

Natsume

[11] Patent Number: 5,516,100

[45] Date of Patent: May 14, 1996

[54] FRP RACKET FRAME AND A METHOD FOR PRODUCING THE SAME

[75] Inventor: Yoshihiro Natsume, Shizuoka, Japan

[73] Assignee: Yamaha Corporation, Japan

[21] Appl. No.: 361,946

[22] Filed: Dec. 22, 1994

[30] Foreign Application Priority Data

Dec. 28, 1993 [JP] Japan ..... 5-349068

[51] Int. Cl.[6] ..... A63B 49/10; A63B 49/02

[52] U.S. Cl. ..... 273/73 D; 273/73 R; 273/73 F

[58] Field of Search ..... 273/73 R, 73 C, 273/73 D, 73 F

[56] References Cited

U.S. PATENT DOCUMENTS

| | | | |
|---|---|---|---|
| 3,815,660 | 6/1974 | Gallagher et al. | 273/73 DX |
| 4,185,822 | 1/1980 | Li | 273/73 DX |
| 4,203,596 | 5/1980 | Nagamoto | 273/73 FX |
| 4,365,806 | 12/1982 | Reid et al. | 273/73 DX |
| 4,436,305 | 3/1984 | Fernandez | 273/73 DX |
| 4,913,434 | 4/1990 | Fischer | 273/73 C |
| 4,983,242 | 1/1991 | Reed | 273/73 FX |
| 5,314,180 | 5/1994 | Yamagishi et al. | 273/73 F |
| 5,460,370 | 10/1995 | Tung-Han | 273/73 DX |

FOREIGN PATENT DOCUMENTS

| | | |
|---|---|---|
| 54-152536 | 11/1979 | Japan . |
| 6-238015 | 8/1994 | Japan . |

*Primary Examiner*—Raleigh W. Chiu
*Attorney, Agent, or Firm*—Ostrolenk, Faber, Gerb & Soffen

[57] ABSTRACT

In production of a tennis or badminton racket frame in a mould under application of heat with pressure, an impervious tube is inserted into an FRP tubular material, a pair of such tubular materials are arranged in a spaced juxtaposition in the mould, a string guide strip having transverse, through string holes is inserted between the pair off tubular materials with it string holes being directed normal to the juxtaposition, and internal pressure is applied into the tubular materials during application of heat with pressure. Formation of the string holes is carried out concurrently with mould shaping of the racket frame, thereby greatly simplifying the process with reduction in cost. Absence of the conventional string hole drilling results in smooth opening of the string holes in the end product, thereby avoiding undesirable string breakage during setting under tension to the head of the racket frame.

7 Claims, 6 Drawing Sheets

FRP RACKET FRAME AND A METHOD FOR PRODUCING THE SAME

BACKGROUND OF THE INVENTION

The present invention relates to an FRP racket frame and a method for producing the same, and more particularly relates to improvements in physical property and shaping fitness of a fiber reinforced plastic (hereinafter referred to as "FRP") racket frame of a tubular construction used for tennis or badminton games.

Such an FRP racket frame contains, for example, fibers dispersed in a matrix of thermosciting synthetic resin such as epoxy resin. One typical example of such an FRP racket frame of a tubular construction is proposed in Japanese Patent Opening Sho. 54-152536, in which a racket frame is made of prepreg material, i.e. an incompletely solidified product containing fibers impregnated with matrix resin. An elongated tubular crude product made of such a prepreg is placed in position in a mould and heated under pressure while applying internal pressure to the tubular crude product for shaping.

In the case of such a conventional production process, however, it is necessary to drill a lot of string holes transverse the body of a racket frame after shaping. Separate formation of such string holes after shaping much lowers efficiency in production and presence of such string holes degrades mechanical strength of tile product seriously.

After formation of the string holes, strings are set to the racket frame in tension past tile string holes. Due to presence of sharp edge openings of the string holes developed by drilling, the strings in tension tend to cut during setting to the racket frame.

In an attempt to evade such cutting through contact with the sharp edge openings, it is already proposed to cover each sharp edge opening with a grommet made of soft synthetic resin such as nylon. Use of such grommets, however, complicates the production process and increases the production cost.

SUMMARY OF THE INVENTION

It is the basic object of the present invention to improve physical properties and shaping fitness of an FRP racket frame of a tubular construction.

In accordance with the first aspect of the present invention, a racket frame includes a substantially oval frame main body. An elongated reinforcement rib traverses the interior of the frame main body in the face plane direction to divide the interior into two elongated cavities which are juxtaposed in the ball striking direction. A string guide strip is embedded in the reinforcement rib and provided with string holes extending in the face plane direction.

In accordance with the second aspect of the present invention, a method for producing a racket frame includes placing in spaced juxtaposition a pair of tubular materials for the racket frame in a mould. A string guide having string holes in position is inserted between the pair of tubular materials in an arrangement such that the string holes extend in a direction normal to the juxtaposition of the tubular materials. The mould is heated under pressure while applying internal pressure into the tubular materials.

In one preferred embodiment of the present invention, the string guide strip is made off a plurality of alternate planar sections and tubular sections, and each tubular section includes a through string hole which extends in the width direction of the string guide strip.

In another preferred embodiment of the present invention, the string guide strip takes the form of a strap having transverse, through string holes, and the string holes are arranged in a spaced juxtaposition and extend in the width direction of the string guide strip.

In the other preferred embodiment of the present invention, the string guide strip is made up of an elongated guard and a plurality of parallel, tubular projections and each tubular projection includes a through string hole which extends in the width direction of the string guide strip.

In a still other preferred embodiment of the present invention, the string guide strip is made up of a plurality of alternate tubes and connectors, and each tube is provided with a through string hole and extends in the width direction of the string guide strip.

In a still other preferred embodiment off the present invention, the method further includes the step of inserting an impervious tube into each tubular material before moulding.

DESCRIPTION OF PREFERRED EMBODIMENTS

Figure 1:
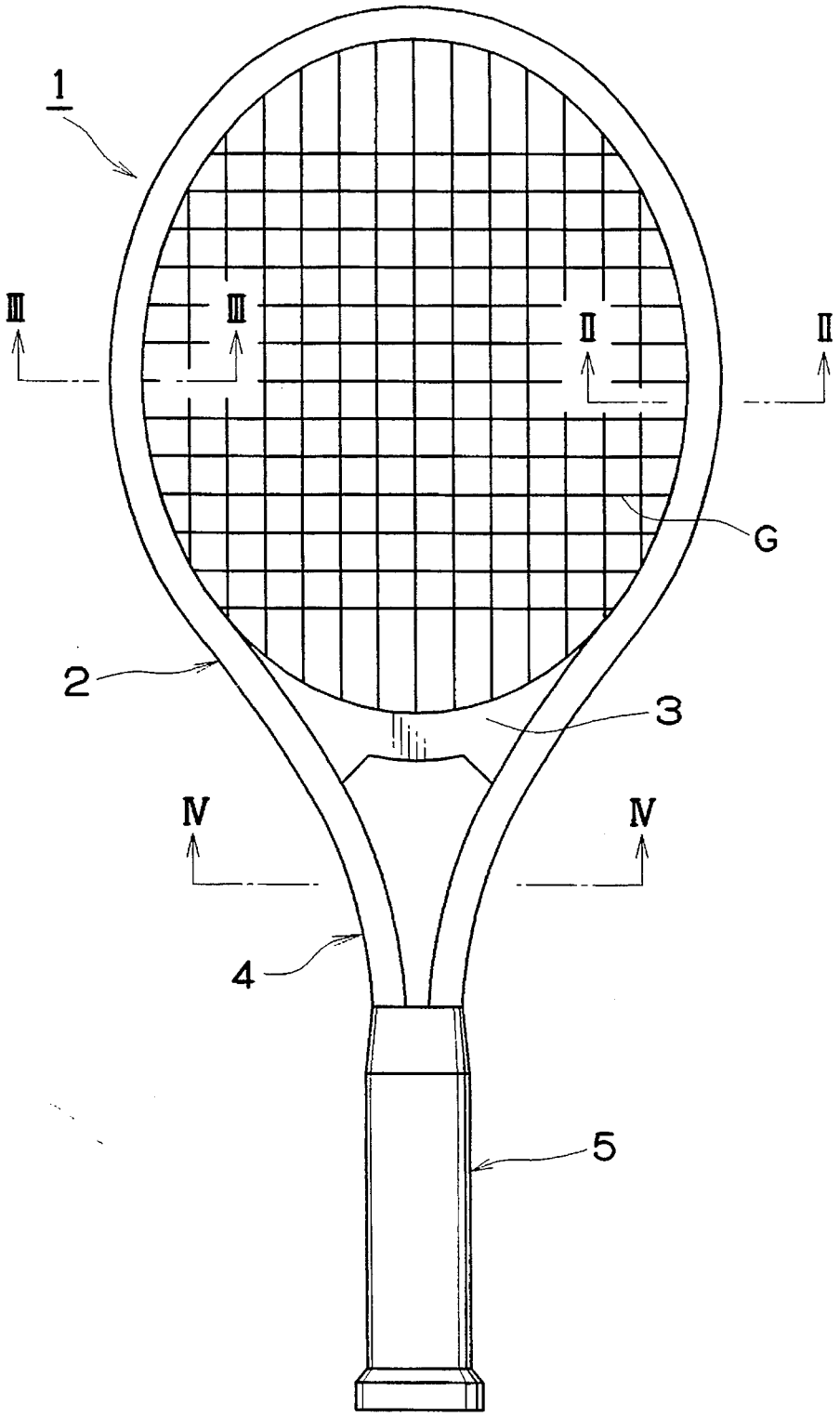
FIG. 1 is a plan view off one embodiment of the racket frame produced in accordance with the present invention.

The entire structure of the racket frame in accordance with the present invention is shown in FIG. 1, in which a frame main body 1 spans a head 2 with main and cross strings G and a shaft 4 which includes a throat 3 and a grip 5.

Figure 2:
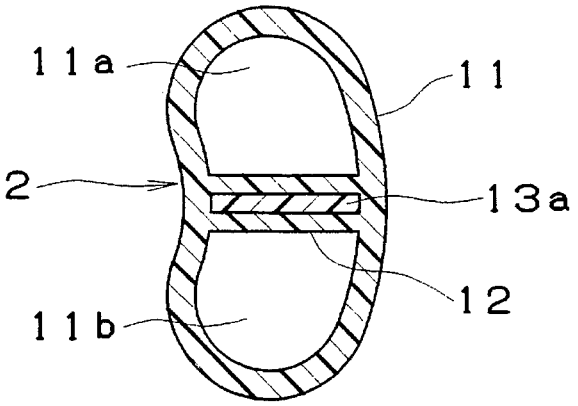
FIG. 2 is a transverse cross sectional view taken along a line H—II in FIG. 1.
Figure 3:
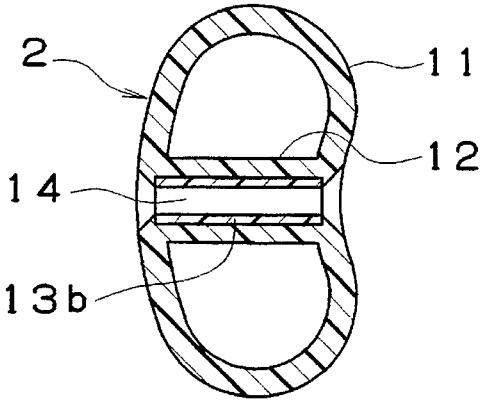
FIG. 3 is a transverse cross sectional view taken along a line III—III in FIG. 1.
Figure 4:
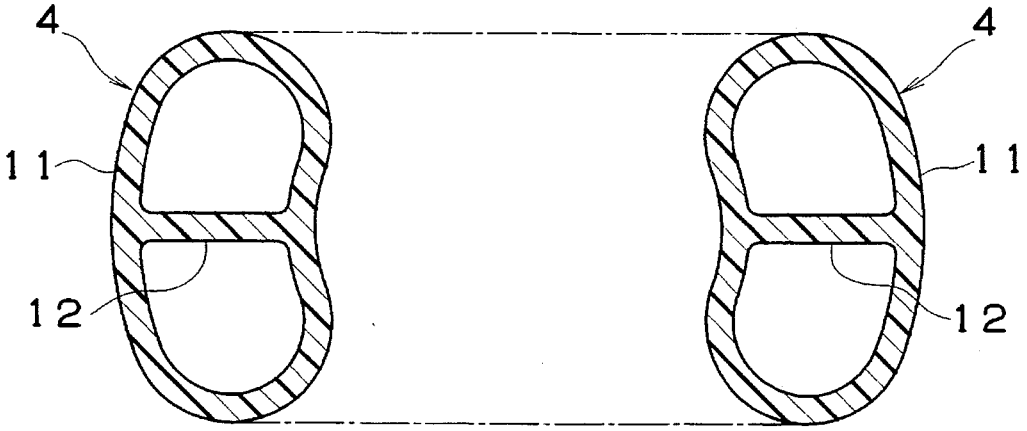
FIG. 4 is a transverse cross sectional view taken along a line IV—IV in FIG. 1.

As shown in FIGS. 2 to 4, the frame main body 1 has a shell 11 made of FRP the interior of which is divided into a pair of, elongated cavities 11*a* and 11*b* by a reinforcement rib 12 extending in the face plane direction. Stated otherwise, the elongated cavities 11*a* and 11*b* are juxtaposed in the ball striking direction whilst sandwiching the reinforcement rib 12. At both ends, the reinforcement rib 12 merge in one body into the shell 11. As shown in FIGS. 2 and 3, a string guide strip 13 is fully embedded in the reinforcement rib 12 except for its string hones 14 which open at both ends.

Figure 5:
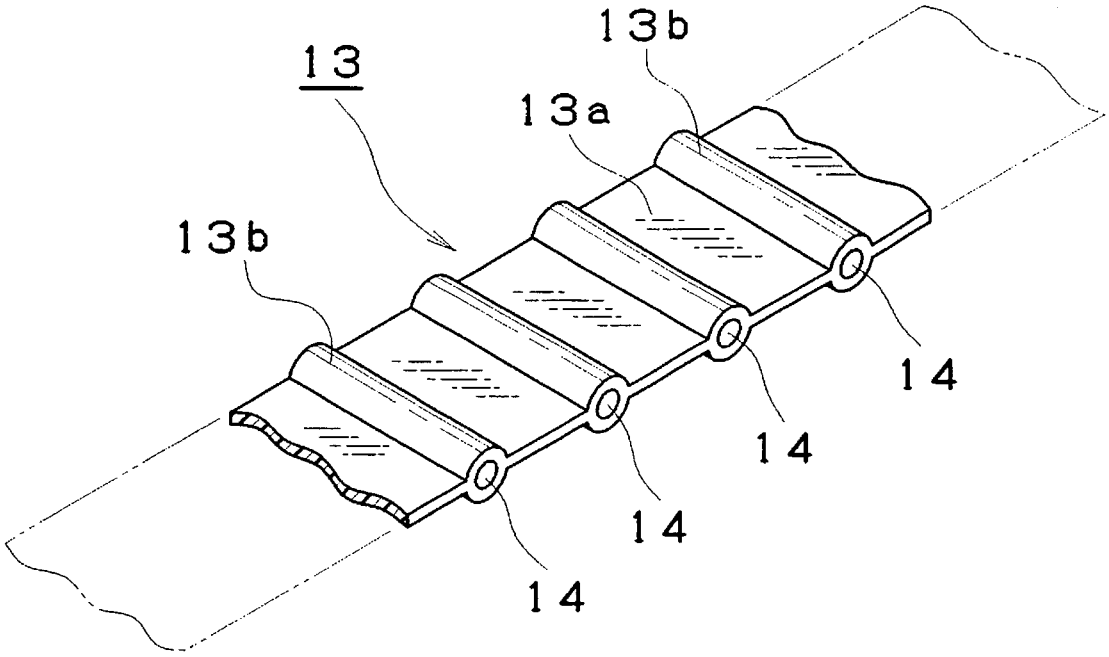
FIG. 5 is a perspective view off one example of the string guide strip used for the racket frame shown in FIG. 1.

One example of such a string guide strip 13 is shown in FIG. 5, in which the string guide strip 13 is made up of alternate planar sections 13*a* and tubular sections 13*b*. Each tubular section 13*b* includes one string hole 14 which extends in the width direction of the string guide strip 13 and opens at both longitudinal ends. The planar section 13*a* appears in FIG. 2 whereas the tubular section 13*b* appears in FIG. 3. As best soon in FIG. 3, the shell 11 has a conical depression communicating to the end opening of each string hole 14 in the string guide strip 13. Since the string guide strip 13 extends in the circumferential direction of the head 2, the string holes 14 are arranged at adequate intervals along the circumference of the head 2.

Figure 6:
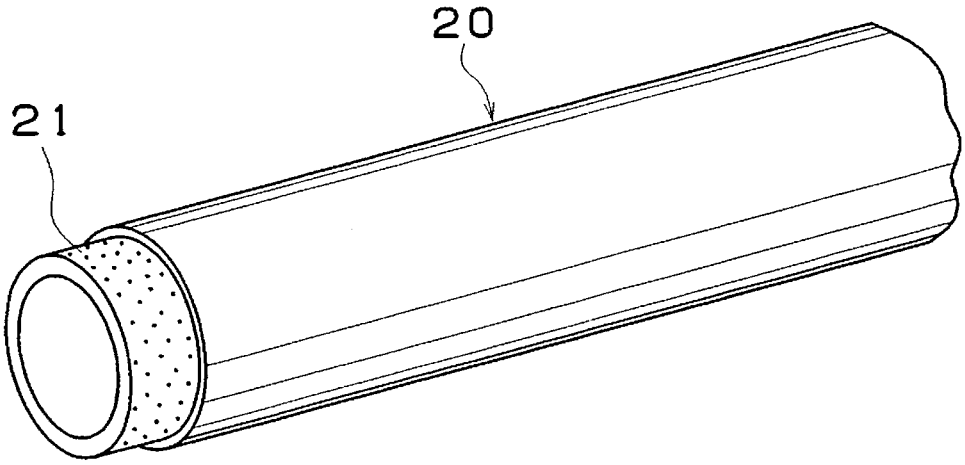
FIG. 6 is a perspective view off one example of the tubular material used for production of the racket frame shown in FIG. 1, FIGS. 7 and 8 are sectional side views for showing production of the racket frame in accordance with the present invention at different sections.

For production of such a racket frame, a long tubular material 20 such as shown in FIG. 6 is used. The tubular material 20 is made of a mixture of thermoplastic resin such as nylon resin with dispersed reinforcing fibers of glass or carbon, namely, FRP. An elastic, impervious tube 21 made of, for example, silicon is coaxially inserted into the tubular material 20.

Figure 7:
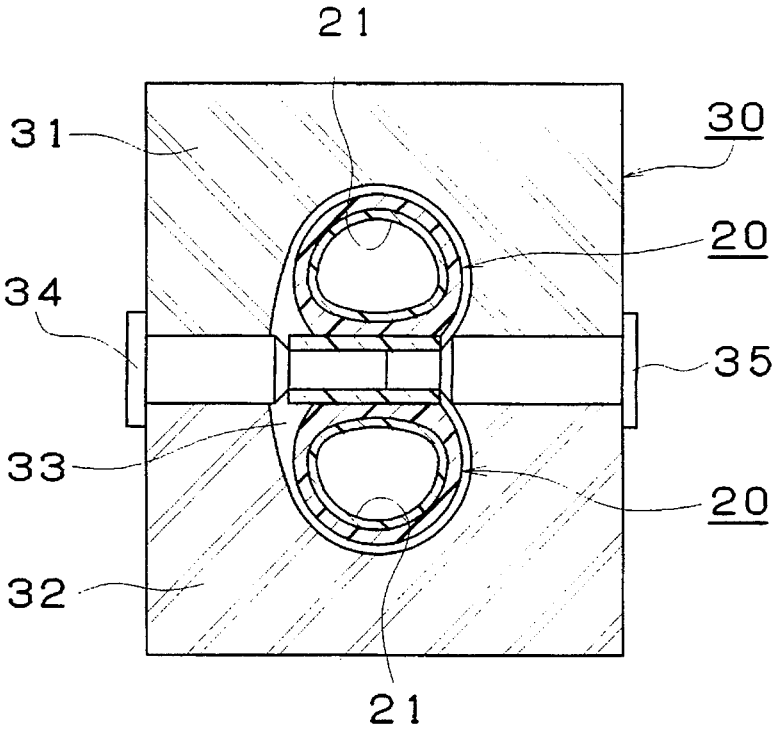
Figure 8:
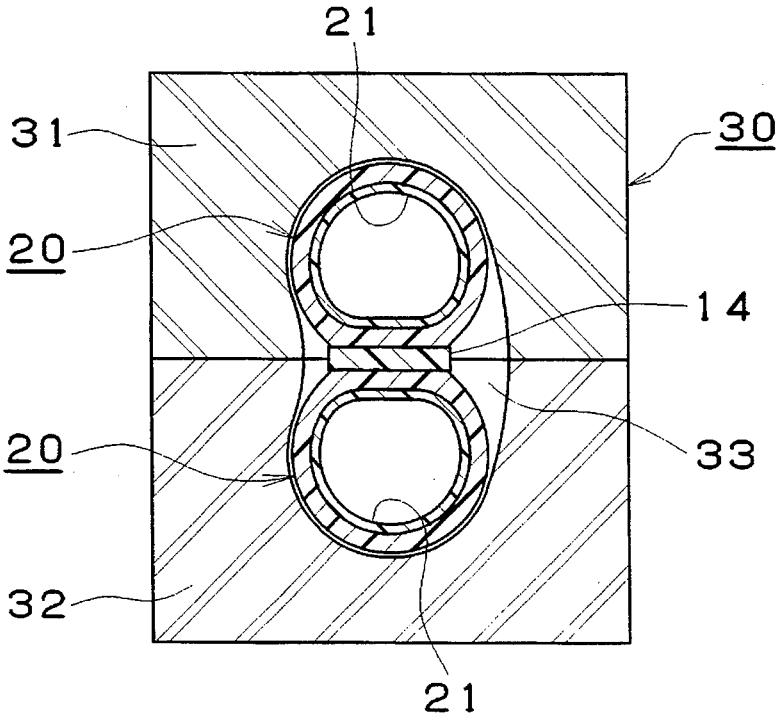

Next, as shown in FIGS. 7 and 8, two tubular materials 20 of such a construction are placed in position in a mould 30 made up off separable mould halves 31 and 32. The cavity 33 of the mould 30 has a shape corresponding to the configuration of the racket frame to be produced. In position within the mould 30, the tubular materials 20 are arranged so that they are juxtaposed in the ball striking direction in the construction of the racket frame to be produced. After the tubular materials 20 are set in position, a string guide strip 13 is inserted between the juxtaposed tubular materials 20. A pair of positioning pins 34 and 35 are inserted into each string hole 14 in the string guide strip 13 from outside of the mould 30 in order to fix the position of the string guide strip 13 within the cavity 33 of the mould 30. It is, however, not required to use the positioning pins 34 and 35 for all the string holes 14. Selected string holes 14 may be caught by the positioning pins 34 and 35 as long as the position of the string guide strip 13 can be fixed within the mould 30.

After firmly closing the mould 30, one ends of the impervious tubes 21 of the tubular materials 20 are closed and fluid such as air is supplied under pressure into the impervious tubes 21 via the other ends. Resultant expansion of each impervious tubes 21 presses an associated tubular material 20 against the wall of the mould cavity 33. Under this condition, the entire mould is heated under pressure in order to cause impregnation of the thermoplastic resin into the reinforcing fibers. Subsequent cooling solidifies the thermoplastic resin and the string guide strip 13 is embedded in one body in the frame main body 1. The section of the frame main body embracing the string guide strip 13 forms the reinforcement rib 12 in the end product.

After demoulding, the impervious tubes 21 are removed from the product and the positioning pins 34 and 35 are removed from the mould 30. Thus, formation of the string holes 14 is carried out concurrently with shaping of the racket frame.

The string guide strip 13 is given in the form of a continuous ring which extends in the circumferential direction of the head in the case of the illustrated embodiment. The ring, however, may be made up of several, discontinuous, sectional components aligned in the circumferential direction of the head.

Figure 9:
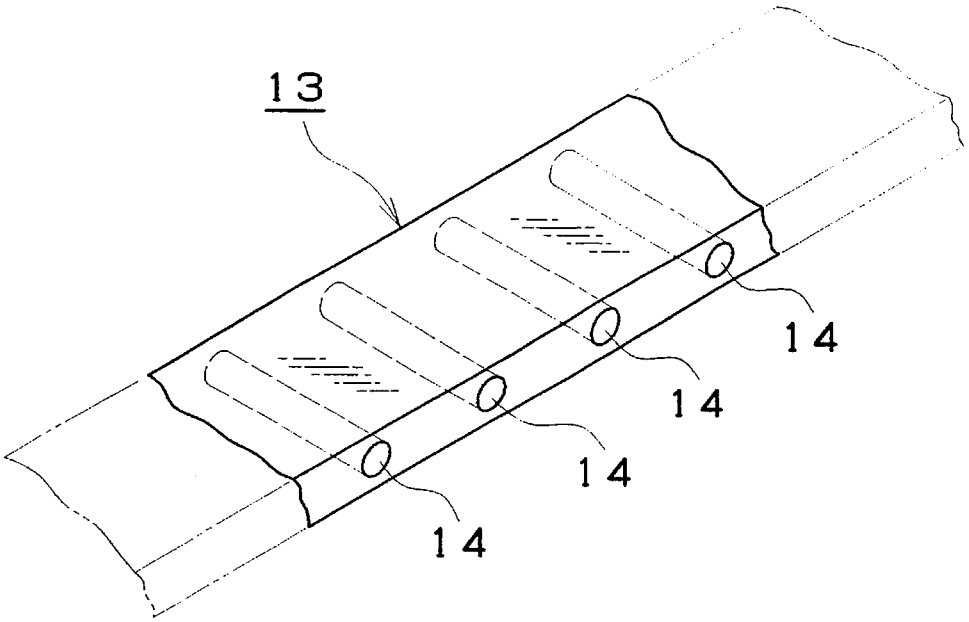
FIG. 9 is a perspective view of another example of the string guide strip.
Figure 10:
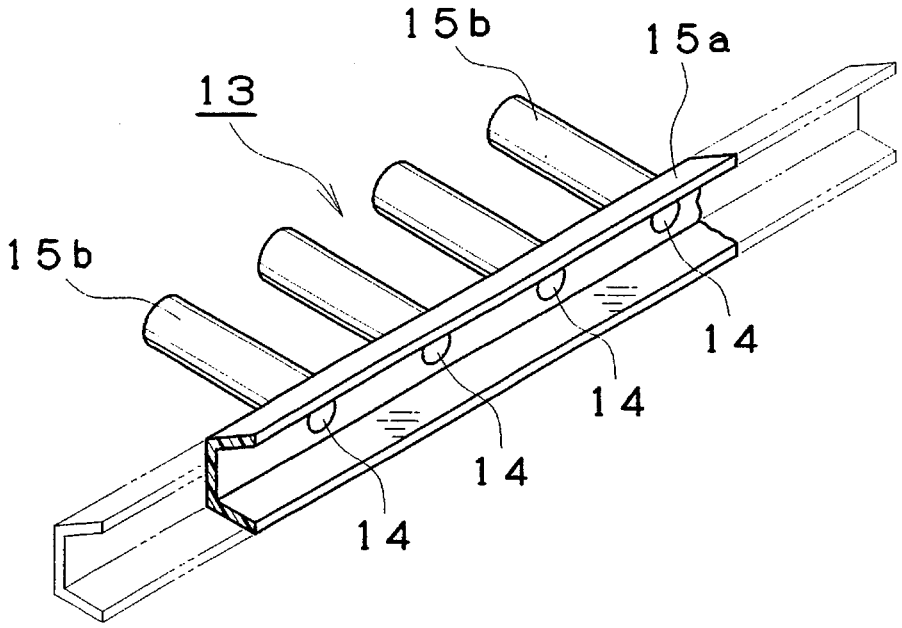
FIG. 10 is a perspective view of the other example of the string guide strip.

Another example of the string guide strip 13 is shown in FIG. 9, in which the string guide strip 13 is given in the form of an elongated strap. The strap includes a number of string holes 14 which are arranged at adequate intervals and extend in the width direction of the strap whilst opening at both longitudinal ends.

Figure 11:
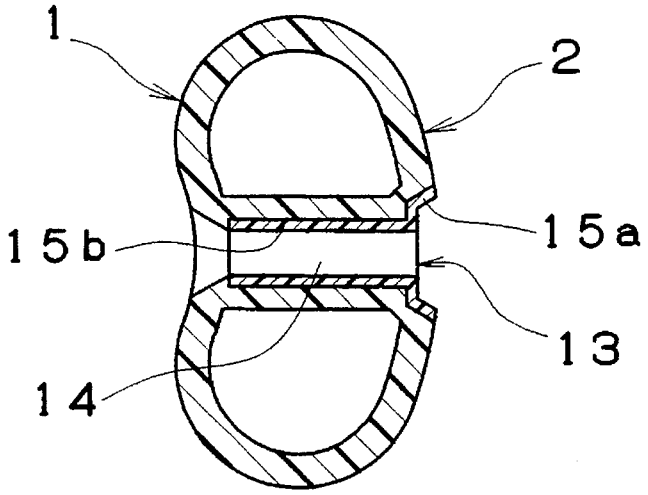
FIG. 11 is a transverse cross sectional view of a racket frame using the string guide strip shown in FIG. 10.

In an alternative, the string guide strip 13 is made up of an elongated guard 15*a* and a number of tubular projections 15*b* protruding almost at a right angle from the elongated guard 15*a*. The tubular projections 15*b* are arranged at adequate intervals and each provided with a through string hole 14. The elongated guard 15*a* has a bottom section and a pair of flare sections which extend from both ends of the bottom section in direction opposite to the tubular projections 15*b*. As shown in FIG. 11, these flare section define a protector groove for the string G.

Figure 12:
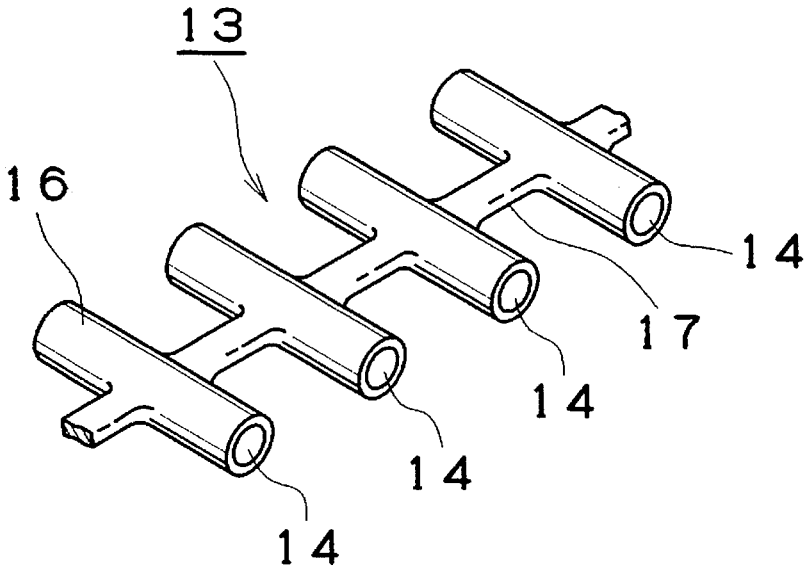
FIG. 12 is a perspective view of a still other example of the string guide strip.

In the case of the example shown in FIG. 12, the string guide strip 13 is made up of alternate tubes 16 and thin connectors 17. The tube 16 extends in the width direction of the string guide strip 13 and provided with a through string hole 14.

When thermoplastic resin is used for the tubular material 20, the melting point of the material for the string guide strip 13 should preferably be higher than that of the material for the tubular material 20.

In accordance with the present invention, a string guide strip having a plurality of holes is fully embedded in a reinforcement rib traversing the interior of an FRP shell in the face plane direction at the stage of shaping a racket frame in a mould and, as a consequence, necessitates no separate drilling of the string holes. No drilling after shaping develops no sharp edge openings of the string holes which otherwise cause accidental cutting of strings during setting to a racket frame. The undesirable breakage of strings is much reduced. In addition, reinforcing fibers in the FRP racket frame are not cut by string hole drilling, thereby effectively preventing degradation in mechanical strength of the racket frame.

Formation of the string holes is carried out concurrently with shaping of the racket frame in a mould, thereby much simplifying production process to reduce the production cost.

What is claimed is:

1. A racket frame comprising a substantially oval FRP racket main body of a tubular construction which form a head of said racket frame, an elongated reinforcement rib traversing an interior of said frame main body in a face plane direction of said racket frame while dividing said interior of said main body into two elongated cavities which are juxtaposed in a ball striking direction of said racket frame, and a string guide strip fully embedded in said reinforcement rib and provided with a plurality of through string holes extending in said face plane direction.

2. A racket frame as claimed in claim 1 in which said string guide strip is made off a plurality of alternate planar sections and tubular sections, and each said tubular section includes a through string hole which extends in a width direction of said string guide strip.

3. A racket frame as claimed in claim 1 in which said string guide strip is given in the form of a strap having through string holes which are arranged in a spaced juxtaposition and extend in a width direction of said string guide strip.

4. A racket frame as claimed in claim 1 in which said string guide strip is made up of an elongated guard and a plurality of parallel, tubular projections, and each said tubular projection includes a through string hole which extends in a width direction of said string guide strip.

5. A racket frame as claimed in claim 1 in which said string guide strip is made up of a plurality of alternate tubes and thin connectors, and each said tube is provided with a through string hole and extends in a width direction of said string guide strip.

6. A racket frame as claimed in claim 1 in which said string guide strip is given in the form of a continuous ring which extends in a circumferential direction of said head.

7. A racket frame as claimed in claim 1 in which said string guide strip is given in the form of a discontinuous ring which is made up of a plurality of sectional components aligned in a circumferential direction off said head.

* * * * *